US008215242B2

(12) United States Patent
Aguayo

(10) Patent No.: US 8,215,242 B2
(45) Date of Patent: Jul. 10, 2012

(54) PORTABLE LAP TRAY

(76) Inventor: Todd M. Aguayo, Phoenix, AZ (US)

( * ) Notice: Subject to any disclaimer, the term of this patent is extended or adjusted under 35 U.S.C. 154(b) by 114 days.

(21) Appl. No.: 12/700,230

(22) Filed: Feb. 4, 2010

(65) Prior Publication Data

US 2011/0185951 A1 Aug. 4, 2011

(51) Int. Cl.
*A47B 23/00* (2006.01)

(52) U.S. Cl. ..... 108/43

(58) Field of Classification Search ..... 108/43, 108/44, 165, 129, 132; 248/444, 459
See application file for complete search history.

(56) References Cited

U.S. PATENT DOCUMENTS

| | | | | | |
|---|---|---|---|---|---|
| 2,647,678 | A | | 8/1953 | Olson | |
| 2,783,109 | A | | 2/1957 | Frey | |
| 2,808,191 | A | * | 10/1957 | Cramer | 108/43 |
| 2,809,775 | A | * | 10/1957 | White | 229/120 |
| 2,979,990 | A | * | 4/1961 | Alexander | 108/43 |
| 3,709,158 | A | * | 1/1973 | Kidd | 108/43 |
| 4,311,099 | A | | 1/1982 | Roberts | |
| 4,976,204 | A | * | 12/1990 | Konkle | 108/43 |
| 5,038,688 | A | * | 8/1991 | Permenter | 108/43 |
| 5,127,339 | A | * | 7/1992 | Hood, Jr. | 108/43 |
| D354,636 | S | | 1/1995 | Cable | |
| 5,425,455 | A | | 6/1995 | Miller et al. | |
| 5,833,200 | A | * | 11/1998 | Patterson | 108/34 |
| 5,862,933 | A | | 1/1999 | Neville | |
| 6,003,446 | A | | 12/1999 | Leibowitz | |
| 6,152,417 | A | * | 11/2000 | Randall | 108/43 |
| 6,170,405 | B1 | * | 1/2001 | Weitzman et al. | 108/43 |
| 6,173,656 | B1 | | 1/2001 | Blanchard | |
| 6,496,360 | B1 | * | 12/2002 | Cordes et al. | 108/43 |
| 7,055,442 | B2 | * | 6/2006 | Podd et al. | 108/43 |
| D588,373 | S | * | 3/2009 | Rushton | D6/406.6 |
| 2007/0277711 | A1 | | 12/2007 | Grant | |

* cited by examiner

*Primary Examiner* — Jose V Chen
(74) *Attorney, Agent, or Firm* — Bycer Law, PLC

(57) ABSTRACT

A portable and environmentally-friendly lap tray to support items for a seated individual includes a storage surface surrounded by retaining walls. The lap tray includes hinged support wings on the bottom surface to extend between a user's legs. The wings are set apart from one another in an ergonomically preferable position to allow any person to comfortably use the lap tray when seated. Alternatively, the lap tray may be used as a stand. The lap tray may be personalized or customized for particular events with various indicia and add-ons.

7 Claims, 3 Drawing Sheets

PORTABLE LAP TRAY

BACKGROUND OF THE INVENTION

1. Field of the Invention

The present invention is related generally to portable lap trays, and more particularly to lap trays for supporting food upon the lap of a seated individual.

2. Description of the Related Art

Lap support trays are well known in the art for managing food, drinks and the like, or for supporting reading and writing materials upon a hard surface. Many such devices include a single, hard, flat, planar surface on which such items may be placed and supported. Users often use these trays when seated, using their laps to support such trays.

It is sometimes difficult to maintain the balance of a tray upon a user's lap, while preventing the tray from sliding off the lap or otherwise tipping and spilling its contents. Prior developers have attempted to design portable lap trays to help alleviate these problems. Some designs use high-friction materials that will essentially cling to clothing; others are molded to form-fit a user's legs when the users is seated. However, users come in different shapes and sizes, and such prior trays still cause many users discomfort when attempting to make use thereof.

Certain lap trays disclosed in the past feature designs that include a single- or double-wing design to assist support of a lap tray. These wings function to allow a user to engage the tray, usually by holding, resting, or supporting the tray on a lap, or between or around the user's legs. Single-wing designs provide an anchor to prevent major shifting. Double-wing systems contact the inner thighs of each of the user's legs, and have generally helped secure lap trays. No design has yet fully compensated for the ergonomics present in the human pelvis and hip joints, which require a modest separation between the user's legs. As yet, there has not been a lap tray available that is of simple design and construction, easy to manufacture, and which can be properly supported by the average human lap, while accounting for normal leg orientation. Furthermore, the art lacks a design for a lap tray that allows a user to easily adjust tray height and orientation.

OBJECTS OF THE INVENTION

It is therefore an object of the present invention to provide a lap tray for the support of items on one's lap.

It is another object of the present invention to provide a lap tray that accommodates a normal user's hip and leg orientation.

It is an object of the present invention to provide a recyclable lap tray.

It is another object of the present invention to provide an ergonomic low-cost lap tray.

It is still another object of the present invention to provide a lap tray that is easy to use and support when seated.

It is yet another object of the present invention to provide a lap tray that may be securely converted to a standing table.

It is still a further object of the present invention to maximize the utility of a seated individual by providing support for items, i.e. food and drink, reading materials, and the like.

It is yet another object of the present invention to provide a lap tray that is collapsible and easy to store.

It is an still another object of the present invention to provide a durable lap-tray for repeated uses.

These and other objects of the present invention will become apparent to those skilled in the art as the present description proceeds.

SUMMARY OF THE INVENTION

In accordance with one embodiment of the present invention, a lap tray includes two planar bodies, one set atop the other. A perimeter wall extends upwardly above the top planar body to form a container. The bottom planar body includes two wing support members to engage a user's lap. Situated between the two wing supports is a central portion. The central portion is contained between two integral hinges, which are preferably oriented parallel to one another. The two integral hinges are set apart from one another at a predetermined distance, and the wing supports extend outwardly from their respective integrated hinges. The bottom planar body may further include a perimeter area, set around the wing supports, thus enlarging the overall size of the tray.

Each wing support includes an initially hidden interior surface. As each wing support is deployed, the interior surface is used to engage a user's inner thighs for support of the lap tray. The wing supports may include thumb handles formed as partial apertures at the ends of the wing supports. The lap tray may be made formed from a single piece of cardboard that is folded upon itself to provide both the top planar body and the bottom planar body.

In a second embodiment of the present invention, a lap tray device includes a first planar member. The first planar member has a first top surface and a first bottom surface. The first planar member is capable of supporting objects optionally set thereupon. A perimeter wall extends above the first planar member, primarily as a retaining wall surface.

The lap tray device includes a second planar member. The perimeter wall may be coupled directly to the second planar member. The second planar member has a second top surface and a second bottom surface. The second planar member is situated functionally parallel to the first planar member, whereby the top surface of the second planar member lies adjacent, and immediately below, the bottom surface of the first planar member. The second planar member further includes two wing supports hingedly coupled to its bottom surface. The first and second wing support members may both be integral with the second planar member.

The first and second wing supports of this second embodiment are each being hingedly coupled to the lap tray at a predetermined distance from each other. The first and second wing supports may each include a handle, possibly for being engaged by a user's thumb. The first and second wing supports can be moved between a stored position generally coplanar with the second planar member, and a deployed position extending angularly from the second planar member. The wing supports extend between and engage the user's legs. The lap tray device may be formed from a single body or piece of cardboard. The first and second wing supports may be hingedly coupled to the second planar member by first and second integral hinges; the first and second integral hinges are preferably situated generally parallel to one another.

In a third embodiment of the present invention, a lap tray device contains a first planar member capable of supporting objects optionally set atop the first top surface by a user. A perimeter may extend around and above the first top surface. The perimeter may include a generally rectangular border member arranged at least partially around the planar member. Two wing supports may extend downwardly from the first planar member to engage a user's lap. A central portion of the first planar member is formed between the wing supports. The first and second wing supports are coupled to the first planar member via first and second integral hinges, respectively. The hinges are set apart from one another at a predetermined distance thus forming the central portion. The wing supports are designed to extend downwardly and away from one another to engage the inner thighs of a user, and thus support at least a portion of the weight of the lap tray.

BRIEF DESCRIPTION OF THE DRAWINGS

The present invention may more readily be understood by reference to the accompanying drawings in which.

DETAILED DESCRIPTION OF THE PREFERRED EMBODIMENTS

Figure 1:
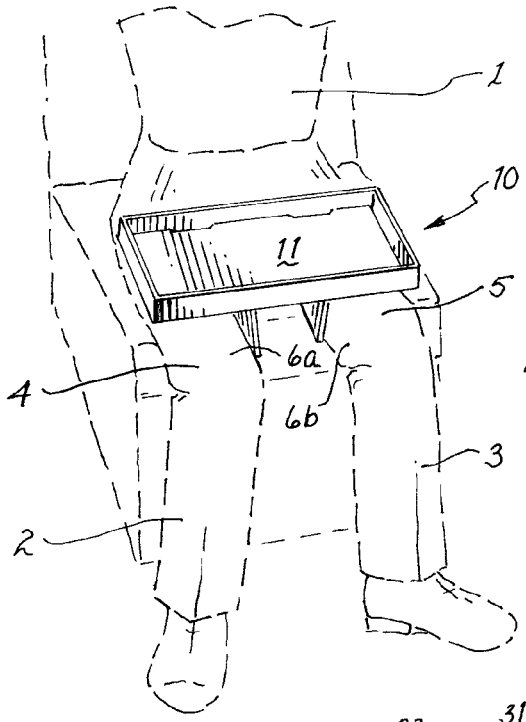
FIG. 1 is a perspective view of a first embodiment of a lap tray in-use upon a user's lap.
Figure 2:
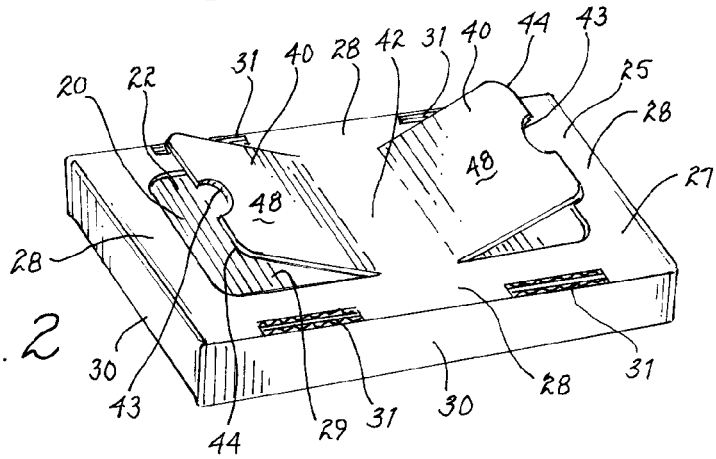
FIG. 2 is a perspective underside view of the lap tray shown in FIG. 1 in a deployed position.
Figure 3:
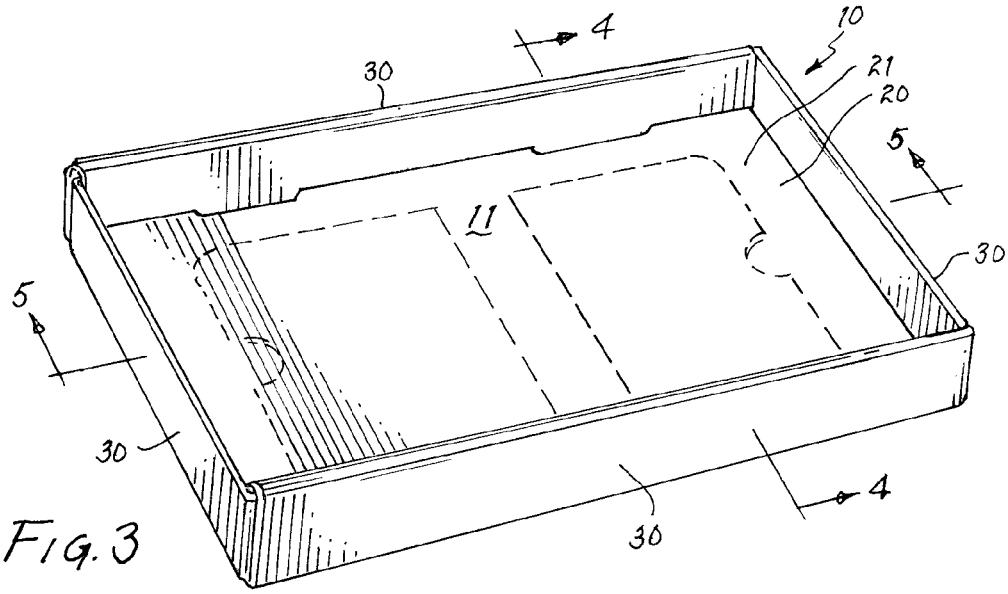
FIG. 3 is a perspective top view of the lap tray shown in FIG. 1 in stored position.

FIG. 1 illustrates user 1 seated in a chair and using a lap tray 10 corresponding to a preferred embodiment of the present invention. Referring to FIGS. 1-3, user 1, has first and second legs 2 and 3, with right and left thighs 4 and 5. Right and left thighs 4 and 5 have inner thigh surfaces 6*a* and 6*b*, respectively, that can engage with lap tray 10. Lap tray 10 includes storage area 11. Storage area 11 displays up for user to set items thereupon. Lap tray 10 includes a first planar member 20 with top surface 21. First planar member 20 may be surrounded by containing walls 30 extending upwardly about its perimeter to define storage area 11. The containing walls 30 may fully surround first planar member 20, or may merely partially surround first planar member 20. Containing walls 30 preferably extend upward above top surface 21 at least ½", and preferably between 1" and 2", with best performance at 1½".

Referring to FIG. 2, second planar member 25 is set below first planar member 20. Bottom surface 22 of first planar member 20 may be seen through cut-outs formed for wing supports 40. Perimeter 28 extends beyond wing supports 40 to further support the wing supports 40 and the tray 10 and second planar member 25 when wing supports 40 are deployed. Perimeter 28 also increases the storage area 11 via enlarging overall area of the complimentary planar members 20 and 25.

It is contemplated that retaining walls 30 may be tangentially connected to one or both of the first planar member 20 and/or the second planar member 25. In the preferred embodiment, containing walls 30 extend about fold lines formed at the perimeter of second planar member 25. It is also contemplated that the containing walls may not be directly coupled to either the first and second planar members 20 and 25, being formed from an additional, or separate, piece of material.

Wing supports 40 engage user's inner thighs 6, with user 1 preferably applying inward pressure to squeeze wing supports 40 together. Wing supports 40 function partially, along with hinges 41, to transfer lateral forces supplied by the user, through the thighs, into vertical force thus supporting lap tray 10 against gravity at a preferred height. Lateral forces supplied by the user further contribute to the balance and maintenance of the tray and storage area 11. These lateral forces allow wing supports 40 to be held at varied angles between a user's legs 2 and 3 to allow user 1 to set preferred angles for deployed wing supports 40.

Lap tray 10 is preferably made from a single folded piece of cardboard, such as type 32 ECT B Brown cardboard, with a vertical corrugation direction. The tray may be created with a blank having initial dimensions of 22¼"×15¼". Final dimensions of the lap tray after assembly are preferably 12"×7½"×1½" (Length×width×height). The tray blank may require a total 248.5745 rule inches. The preferred embodiment may be created from materials supplied by and equipment to perform the cutting, stenciling and folding by THARCO of Tharco Containers Colorado, Inc., 13400 East 39th Avenue, Denver, Colo. 80239-0103.

Referring now to FIGS. 1-6, hinges 41 are preferably integral with second planar member 25. Hinges 41 are preferably parallel to one another and centered in bottom surface 27 of second planar member 25. Central portion 42 is situated between wing supports 40 and is defined by spacing between hinges 41. It is preferable that there be at least one-inch separating hinges 41. It is also preferable that in an alternative embodiment of the invention, hinges will not align in parallel, possibly forming a V-shape, which can include a central portion that reaches at least two-inches at its greatest point. In the preferred embodiment, hinges 41 are generally parallel to one another and spaced approximately two-inches apart, thus defining a rectangular shaped central portion 42 with a width of about two inches. Wing supports 40 open outwardly as shown in FIG. 2. Wing supports 40 are preferably at least four inches wide, to properly engage with the user's thighs, and two inches tall (or long), for best support. In the preferred embodiment with a twelve inch long lap tray, wing supports 40 measure approximately 4.1" by 5.4" (Height by Width). It is also preferable to maintain a ratio between the height of wing support 40 and the length central portion 42. In the preferred embodiment, the wing supports 40 are 4.1 inches long, the central portion 42 is about two inches long, and the preferred ratio of the wing height to central portion length is about 2:1.

Wing supports 40 include wing contact surfaces 48 to engage a user's inner thighs 6*a* and 6*b*. When wing supports 40 are in their stored position (as shown in FIG. 3), wing contact surfaces 48 are generally co-planar with second planar bottom surface 27, and thus virtually hidden. In the preferred embodiment, wing supports 40 are partially cut from second planar member 25.

Thumb inlets 43, or apertures, are contained on the wing support outer edges 44 that allow for manipulation by a user who may alternatively deploy, or store, wing supports 40 in cut-outs 29. Thumb inlets 43 are preferably in the shape of a half-circle for ease of use. Fold-over joints 31 may be formed when the lap tray 10 is folded from a single piece of material 90 in the design herein described.

In an alternative embodiment, wing supports may be fitted with locking wrap 45 that allows a user to set wing supports 40 at a particular predetermined deploy angle 46. Locking wrap 45 acts to put inward force on wing supports 40, in order to maintain wing supports 40 in a preferable predetermined deployed position. Once locking wrap 45 is engaged, lap tray 10 may be set on upon a flat surface, with wing support outer edges 44 providing a bottom surface to engage the flat surface, to form a stand or table.

Figure 4:
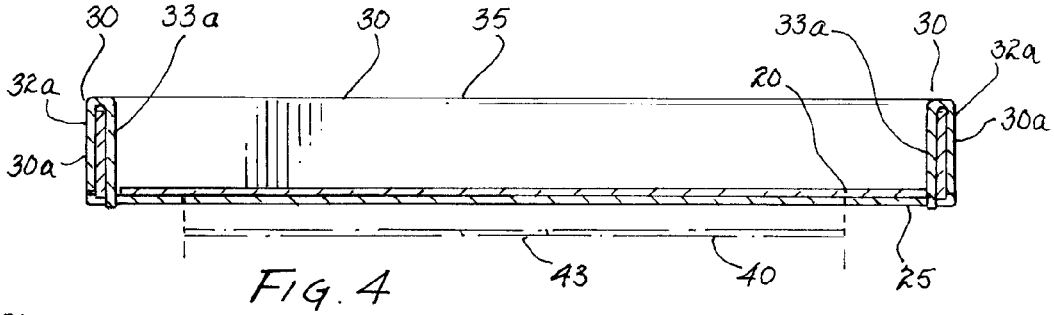
FIG. 4 is a cross-sectional view along Line 4-4 of FIG. 3.
Figure 5:
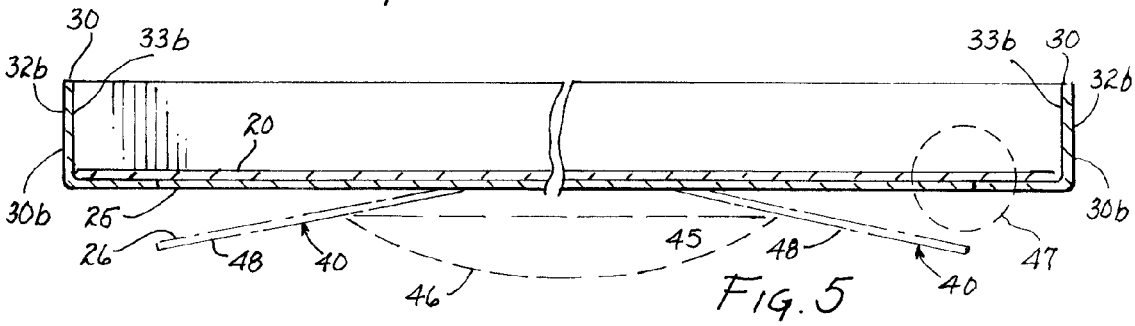
FIG. 5 is a cross-sectional view along Line 5-5 of FIG. 3.

Referring to FIGS. 4 and 5, the frame construction of lap tray 10 includes a doubled-over support bottom supplied by first and second planar members 20 and 25. In the preferred embodiment, the reinforcement of storage area 11 ensures that when wing supports 40 are open/deployed, planar member 20 provides a complete bottom support for storage area 11. Doubled-over bottom of storage area 11 is further supported by a doubled central portion 42 and perimeter 28.

At short ends 35, walls 30 may include a single or double layer of material for strength and ease of use. At long ends 36, walls 30 are doubled or tripled, or further reinforced, to support integrity and strength of walls 30 and to provide an even greater support for items situated in storage area 11.

Figure 6:
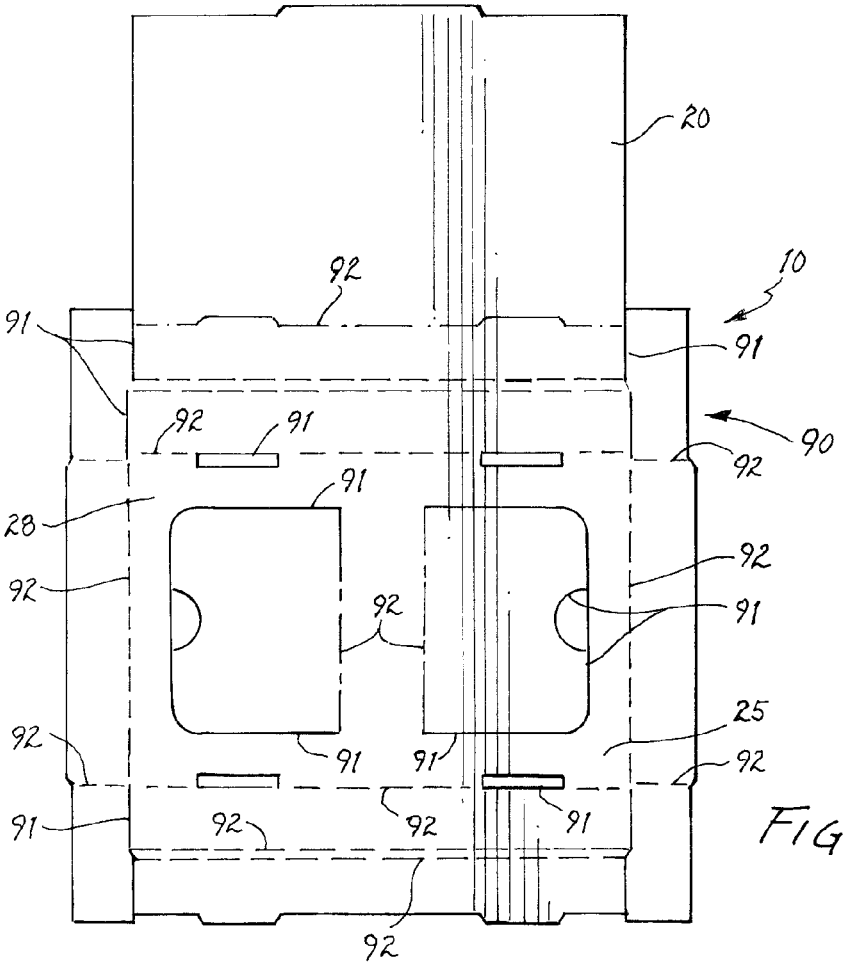
FIG. 6 is a plan view of the lap tray shown in FIG. 1 prior to assembly.

Referring to FIG. 6, a single panel stencil 90 of cardboard is preferably used to construct lap tray 10. Cut-outs 29 are displayed in solid lines, as are all full cuts 91, and bends 92 in dashed lines. Wing support members 40 can be seen as partially cut-out from stencil 90 and held together through integral hinges 41 at bends 92. Wing support hinges 41 may be set integral with second planar member 25, in such a way that bends 92 are formed in second planar member 25 to form hinges 41. Integral hinges 41 generally refers to hinges that are initially formed from the same piece of material, such that it may be possible to form wing supports 40 from the same material as second planar member 25 without fully severing second planar member 25 at hinges 41.

Figure 7:
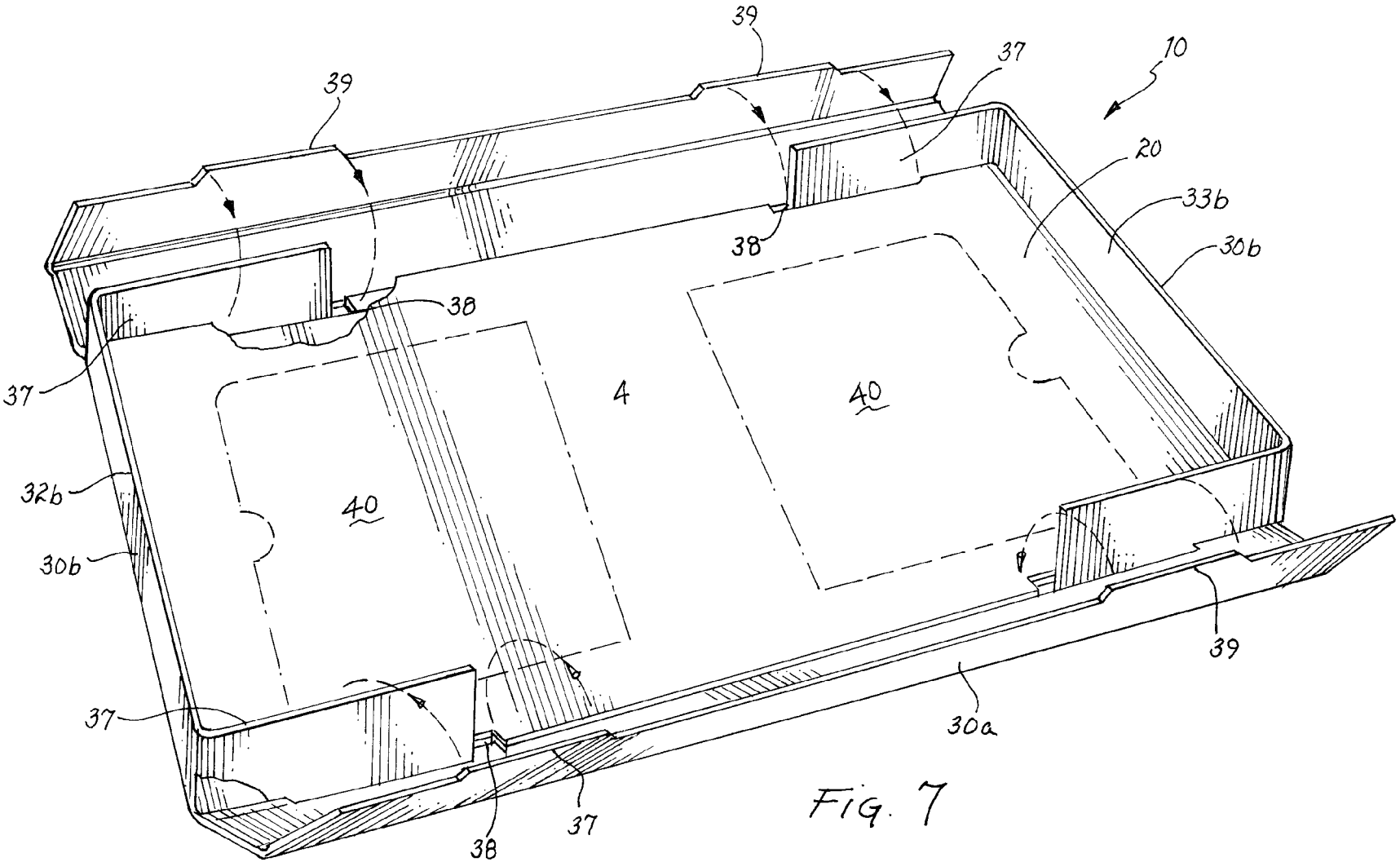
FIG. 7 is a perspective view of the lap tray shown in FIG. 6 after partial assembly.

Referring to FIGS. 6-7, lap tray first planar member 20 is shown. Wing supports 40 are ghosted through first planar member 20 to show their position. Central portion 42 is viewable between hinges 41. First planar member 20 extends along long ends 36 between fold-overs 31 of perimeter walls 30. Long perimeter walls 30*a* include outer wall 32*a* that may be initially connected to second planar member 25 at fold-overs 31. Fold-overs 31 include anchor portion 37 to fit through construction apertures 38 that are cut into the ends of first and second planar members 20 and 25 thus fitting long perimeter walls 30*a*. At long perimeter wall 30*a*, inner wall 33*a* includes nubs 39 to fit into construction apertures 38 of first and second planar members 20 and 25 to further anchor perimeter wall 30.

In an alternative embodiment of the present invention, indicia may be labeled on any surface of lap tray 10. Preferably, indicia will be displayed upon first planar member top surface 21 and/or both sides of walls 30 (i.e. 32*a*, 32*b*, 33*a*, 33*b*), or as needed. It is contemplated that the designs and indicia set upon surfaces of lap tray 10 will cause such item to be a collectible, such that individual designs may be placed upon lap tray 10 for specific sporting, recreational, or entertainment events. Furthermore, in contemplation of race car and NASCAR events, further indicia may be placed on optional wheel panels 47 (preferably four) along the outer walls 32*a*.

The present invention has been described in terms of selected specific embodiments of the invention incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A lap tray device comprising:

a) a first planar member having a first top surface and a first bottom surface, said first planar member capable of supporting objects optionally set upon the first top surface by a user;

b) a perimeter wall extending along said first planar member;

c) a second planar member having a second top surface and a second bottom surface, said second planar member being substantially parallel to said first planar member, said second top surface lying next to said first bottom surface;

said second planar member further including:

i) a first wing support hingedly coupled to the second bottom surface;

ii) a second wing support hingedly coupled to the second bottom surface at a predetermined distance from said first wing support;

iii) each of said first and second wing supports being movable between a stored position, generally co-planar with said second planar member, and a deployed position, extending angularly from said second planar member.

2. The lap tray device of claim 1 wherein the lap tray device is formed from a single piece of cardboard.

3. The lap tray device of claim 1 wherein said first and second wing supports each include a handle for being engaged by a user.

4. The lap tray device of claim 1 wherein said perimeter wall is coupled to said second planar member.

5. The lap tray device of claim 1 wherein said second planar member and said first and second wing support members are integral with each other.

6. The lap tray device of claim 1 wherein said first wing support is hingedly coupled to said second planar member by a first integral hinge, said second wing support is hingedly coupled to said second planar member by a second integral hinge, and said first and second integral hinges are situated generally parallel to one another.

7. The lap tray device of claim 6 wherein said first and second integral hinges are separated from each other by said predetermined distance.

* * * * *